United States Patent [19]

Franks, Jr.

[11] 4,306,447

[45] Dec. 22, 1981

[54] Y-RAM TESTER

[75] Inventor: Robert L. Franks, Jr., Lake Charles, La.

[73] Assignee: Wells Tools, Inc., Lake Charles, La.

[21] Appl. No.: 127,861

[22] Filed: Mar. 6, 1980

[51] Int. Cl.[3] ..... G01M 3/28

[52] U.S. Cl. ..... 73/46; 73/40.5 R; 285/155

[58] Field of Search ..... 73/46, 40.5 R; 285/155

[56] References Cited

U.S. PATENT DOCUMENTS

| | | | |
|---|---|---|---|
| 2,067,499 | 1/1937 | Millmine | 73/46 X |
| 2,334,303 | 11/1943 | Allen et al. | 73/46 |
| 2,350,867 | 6/1944 | Bean et al. | 166/14 |
| 2,485,497 | 10/1949 | Lemley et al. | 285/22 |
| 2,540,322 | 2/1951 | Christensen | 73/40.5 R X |
| 3,080,181 | 3/1963 | Watts et al. | 285/137 |
| 3,093,996 | 6/1963 | Jones | 73/46 |
| 3,177,703 | 4/1965 | Waters et al. | 73/46 X |
| 3,189,097 | 6/1965 | Haeber | 166/66.5 |
| 3,872,713 | 3/1975 | Ilfrey et al. | 73/46 X |
| 3,897,824 | 8/1975 | Fisher | 73/40.5 R X |
| 4,018,276 | 4/1977 | Bode | 73/40.5 R X |
| 4,046,191 | 9/1977 | Neath | 166/0.5 |
| 4,090,395 | 5/1978 | Dixon et al. | 73/40.5 R |
| 4,159,637 | 7/1979 | Lamb et al. | 73/46 |

*Primary Examiner*—Charles A. Ruehl
*Assistant Examiner*—Joseph W. Roskos
*Attorney, Agent, or Firm*—Fisher, Christen & Sabol

[57] ABSTRACT

A Y-ram tester for the testing of the blowout prevention apparatus of a gas or oil well. There is a well casing, a well casing segment mounted thereon, and a blowout preventer which has a pair of pipe rams and is mounted on the well casing segment. The rams are adapted to tightly seal around the two pipes. A test plug is mounted in the well casing in a manner so that the test plug would not move any further into the well casing. Two pipes extend through the center passage of the blowout preventer to a position past the pair of rams. There is also means for injecting water at high pressure into the cavity formed by the central passage of the blowout preventer below the pair of rams, the central passage of the well casing segment and the central passage of the casing of the well casing above the test plug. The adapter or Y-ram tester includes a cross member, a lower member, which is mounted at a right angle to the cross member, means for attaching the lower member to the test plug, two upper members, each of which is mounted at right angle to the cross member, and means for attaching the upper members to the ends of the two pipes located within the cavity.

5 Claims, 2 Drawing Figures

Y-RAM TESTER

BACKGROUND OF THIS INVENTION

1. Field of this Invention

This invention relates to the field of testing the blowout prevention apparatus of gas, oil, water and/or stream wells.

2. Prior Art

After a well has been drilled and the well casing is in place, ram-type blowout prevention apparatus is placed on top of the well casing. Or, such blowout prevention apparatus may be in place during drilling. Such blowout prevention apparatus has to be tested for leaks when subjected to high pressures eminating from within the well casing (i.e., high pressure gas, oil, etc.).

When the blowout prevention apparatus of a gas, oil, water and/or steam well is tested, one is usually involved with a well casing, a well casing segment mounted thereon, and a blowout preventer on the well casing segment. The blowout preventer has a pair of tube or pipe rams which are adapted to tightly seal around at least two pipes or tubes extending through the blowout preventer. A test plug is mounted in the well casing in a manner so that the test plug will not move any further into the well casing. Normally the well casing has a rim which prevents passage of the test plug. The two or more pipes or tubes extend through the center passage of a blowout preventer to a position past the pair of rams. There is also means for injecting fluid at high pressure, usually water, into the cavity formed by the central passage of the blowout preventer below the pair of rams, the central passage of the well casing segment and the central passage of the casing of the well casing above the test plug. The two or more pipes or tubes are blocked (or capped) on one end to prevent passage of the high pressure testing fluid. The high pressure test fluid allows checking for leaks, etc., around the tubes or pipes where contacted by the two rams. But this presents a very dangerous situation. The high pressure test fluid is used at pressures of up to 20,000 p.s.i. or so. The high pressure test fluid often forces or blows one or more of the tubes or pipes explosively up through the rams. The ejected tubes or pipes often cause serious damage to the surrounding well equipment and may cause serious bodily injury to personnel at the well site. In an effort to prevent the explosive ejection of the pipes or tubes, chains and the like are sometimes wrapped around the pipes or tubes and attached to nearby parts of the above ground well (drilling) structure'but this is a very unsuccessful procedure.

BROAD DESCRIPTION OF THIS INVENTION

An object of this invention is to provide a device which eliminates the above-stated safety problem. Other objects and advantages of this invention are set out herein.

The objects and advantages of this invention are achieved by the device, combination and process of this invention.

This invention involves an adapter for use in the testing of the blowout prevention apparatus of a gas, oil, water and/or steam well. The adapter includes a cross member, a lower member, which is mounted at about a right angle to the cross member, and at least two upper members. Each of the upper members is mounted at about a right angle to the cross member. The lower member and the upper members preferably lie in a common plane. The lower member has a threaded portion on its extremity away from the cross member. Each of the upper members has an internally threaded hole in its extremity away from the cross member. The threaded hole of each upper member has a central axis which parallels or coincides with the axis of the upper member in which the internally threaded hole is located. Normally there are two upper members.

This invention also involves a combination for the testing of the blowout prevention apparatus of a gas, oil, water and/or steam well. The combination includes a well casing, a well casing segment mounted thereon and a blowout preventer mounted on the well casing segment. The blowout preventer which has a pair of pipe rams. The rams are adapted to tightly seal around at least two pipes which extend through the blowout preventer. A test plug is mounted in the well casing in a manner that prevents the test plug from moving any further into the well casing. The pipes match in number the openings in the pair of rams. The rams are adopted by means of their opening to tightly seal around the pipes. The pipes extend through the center passage of the blowout preventer to a position past the pair of rams. There is means for injecting fluid at high pressure, usually water, into the cavity formed by the central passage of the blowout preventer below the pair of rams, the central passage of the well casing segment and the central passage of the casing of the well casing above the test plug. The improvement of this invention re the combination is an adapter comprised of a cross member, a lower member, and at least two upper members. The lower member is mounted at about a right angle to the cross member. There is means for attaching the lower member to the test plug. Each of the upper members is mounted at about a right angle to the cross member. The number of upper members matches the number of pipes. There is also means for attaching the upper members to the ends of the pipes located within the cavity. Normally there are two pipes the rams tightly seal around, and the adapter has two upper members. Preferably, the means for attaching the adapter to the test plug is a male threaded portion on the end of the lower member of the adapter which engages an internally threaded hole on the top of the test plug. Also, preferably, the means for attaching each of the upper members to one of the pipes if an internally threaded hole in the end of the upper member which engages a male threaded portion on the end of the pipe.

This invention also includes a process for testing the blowout prevention apparatus of a gas, oil, water and/or steam well which includes using the combination and the improvement thereto (i.e., adapter) to achieve such testing.

The device or Y ram adapter of this invention can be used in the testing of the blowout prevention (or stoppage) apparatus of a gas, oil, water and/or steam well where rams, bellows or the like are used for tightly sealing around pipes located inside of the well casing. As mentioned, the device of this invention can be used in conjunction with geothermal wells.

DETAILED DESCRIPTION OF THIS INVENTION

The preferred embodiment of this invention is set forth in the drawing, in which.

Figure 1:
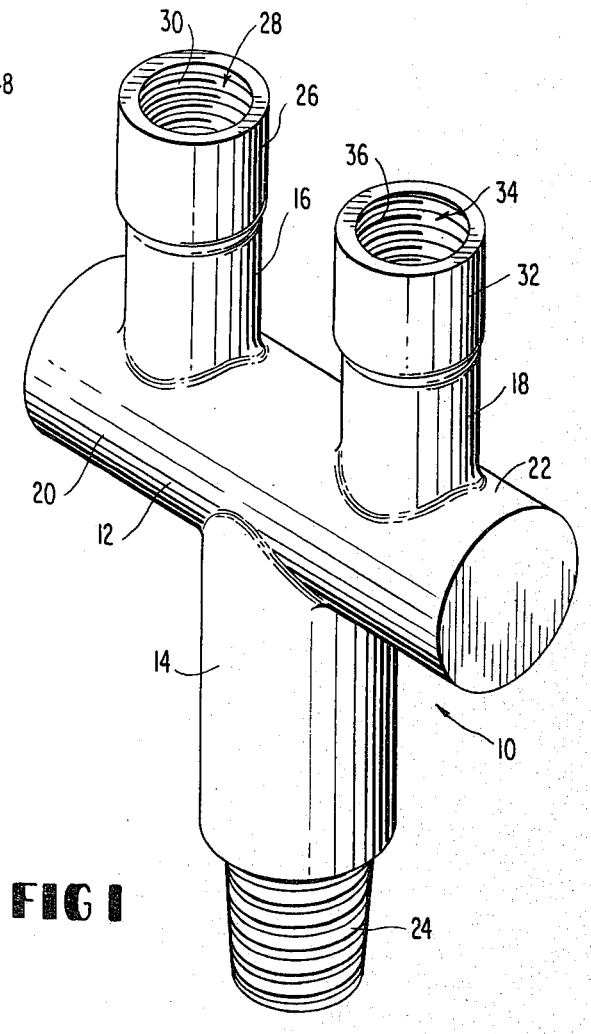
FIG. 1 is a perspective view of the device of this invention.

FIG. 1 shows the preferred form of device 10 of this invention. Device 10 contains cross member 12, lower member 14 and upper members 16 and 18. Upper member 16 is mounted at a right angle to arm 20 of cross member 12; and upper member 18 is mounted at a right angle to arm 22 of cross member 12. Lower member 14 is mounted at a right angle to cross member 12. Preferably lower member 14 is mounted at the center of or in the center section of cross member 12. Preferably lower member 14 and upper members 16 and 18 lie in the same plane. Lower member 14 is provided on its lower extremity with threaded portion or nipple 24 (normally tapered). Except for threaded portion 24, lower member can have any regular or irregular cross sectional shape, for example, circular (preferred), square, hexagonal, pentagonal, rectangular, eliptical, etc. The extremity of upper member 16 away from cross member 12 is provided with protrusion or expanded portion 26. Expanded end 26 of upper member 16 contains vertical hole 28 therein. Vertical hole 28 is internally threaded (30) and does not extend below expanded end 26. The extremity of upper member 18 away from cross member 12 is provided with expanded portion 32. Expanded end 32 of upper member 18 contains vertical hole 34 therein. Vertical hole 34 is internally threaded (36) and does not extend below expanded end 32. Upper members 16 and 18 (including expanded ends 26 and 32) can have any regular or irregular cross sectional shape, for example, circular (Preferred) square, hexagonal, pentagonal, rectangular, eliptical, etc.

Figure 2:
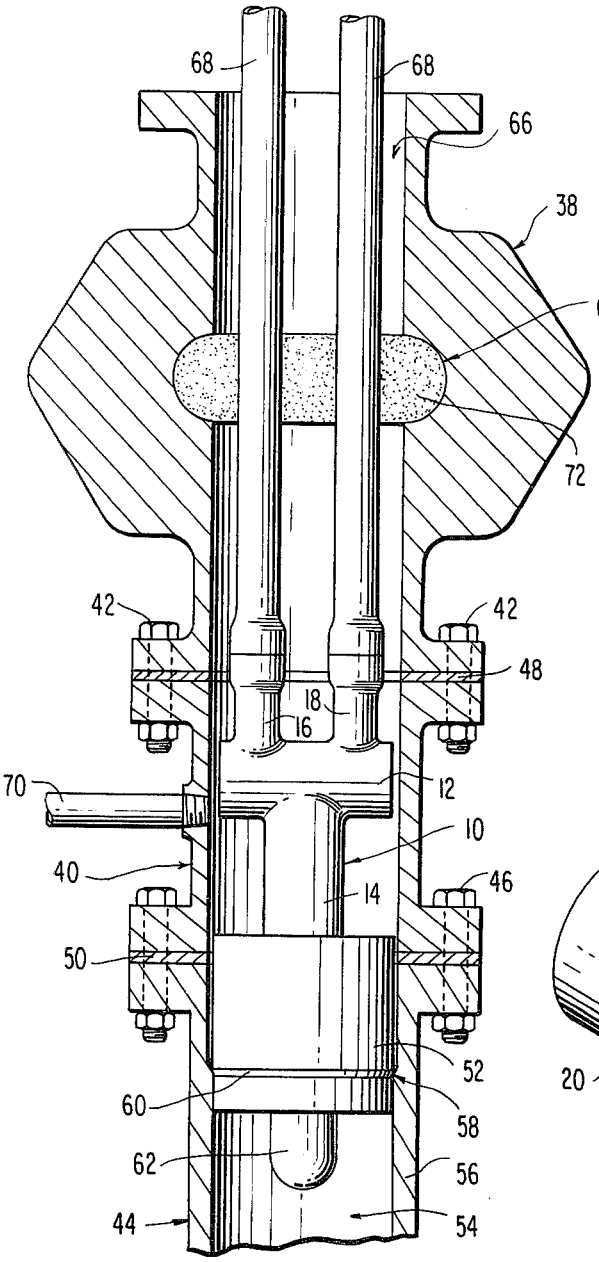
FIG. 2 is a front, partially cutaway, elevational view of the top portion of a well containing the device of this invention.

In FIG. 2, blowout preventer 38 is mounted on well casing segment 40 by means of bolts 42. Casing segment 40 is mounted on well casing 44 by means of bolts 46. 48 and 50 are gaskets to help provide high pressure seals. Blowout preventer 38 is a conventional blowout preventer of the pipe ram type which is widely known and used in the petroleum industry. Only one blowout preventer is shown in FIG. 2, but it is often conventional to have a double blowout preventer (pipe ram type) mounted on top of blowout preventer 38. (Some type of an annular type blowout preventer is mounted on the double blowout preventer.)

After drilling has been completed, the drilling pipe is removed. Often two or more pipes are to be inserted into the well to different depths to pump out oil and/or gas found at different levels. Before the two or more pipes are inserted into the well, the blowout prevention system must be tested. To do this, test plug 52 is inserted into central passage 54 of well casing 44. Wall 56 of well casing 44 thickens just below the top of well casing 44 to form internal rim 58. Test plug 52 narrows at its lower extremity to form rim 60 which mates with rim 58 of well casing 44. This prevents test plug 52 from passing any further down well casing 44, even when high pressure is asserted on the top of test plug 52. 62 is a bull plug on the bottom of test plug 52.

Blowout preventer 38 contains central passage 66 and a pair of rams 64 mounted in the sides of passage 66. Each ram 64 has a flat face 72, which contains two parallel semicircular grooves. Each ram 64 is steel with a rubber layer on face 72. Two pipe segments 68 extend into central passage 66 down towards the bottom of blowout preventer 38. The lower end of each pipe segment 68 has an externally threaded portion, which are screwed into vertical holes 28 and 34 of upper members 16 and 18. This means the end of each pipe segments 68 does not have to be blocked or capped during the pressure testing. The grooves in rams 64 are firmly placed around pipe segments 68.

To achieve the pressure testing for the leakproofness of rams 64 around pipe segments 68, high pressure fluid, usually water (up to 20,000 p.s.i.), is injected from a source (not shown) via pipe 70 mounted in the side of well casing segment 40 into the cavity formed by central passage 66 of blowout preventer 38 below rams 64, the central passage of well casing segment 40 and the central passage of well casing 44 above test plug 52. Device 10 prevents pipe segments 68 from being explosively forced out through the grooves of rams 64. After testing, rams 64 are opened, and tubes 68, device 10 and test plug 52 are removed.

Device 10 can be fabricated in any suitable mannner. For example, lower member 14 and upper members 16 and 18 can be welded to cross member 12. Device 10 can be prepared by casting or molding. Reaming, drilling, cutting, etc., is done as necessary to provide threaded male (nipple) member 24, and threaded female holes 28 and 34.

Preferably, lower member 14, cross member 12 and upper members 16 and 18 all lie in a single plane and each have a straight central axis.

If more than two pipes (for example, three, four, five, etc.) are used in well casing 44, then a corresponding number of upper members is used with device 10. The upper members can be mounted on one cross member, or a Y-shaped, X-shaped, etc., cross (horizontal) member.

Device 10 is preferably constructed of steel, but can be made of any other suitable material which is of sufficient strength to withstand the very high stresses and strains to which device 10 is subjected during the ram-testing. Well casing 44 is usually coupled steel pipes used to provide for the sides of the well hole. Well casing 44 and well casing segment 40 are constructed of steel, but can be made of any other suitable material which has sufficient strength and corrosion resistant properties. The same is so for most of the parts of blowout prevention apparatus 38.

Casing segment 40 can be eliminated, with blowout preventer 38 being directly mounted on well casing 44. The pressure fluid is then injected by any other suitable means, such as, by a pipe mounted in the lower wall of blowout preventer just above its lower flange.

As used herein, the term "at about a right angle" includes a right angle and deviations of up to 20 to 45 degrees or so therefrom.

What is claimed:

1. An adapter for use in the testing of the blowout prevention apparatus of a gas, oil, water and/or steam well comprised of a cross member, a lower member, which is mounted at about a right angle to the cross member, at least two upper members, each of which is mounted at about a right angle to the cross member, the lower member and at least two upper members lying in a common plane, the lower member having a threaded portion on its extremity away from the cross member, and each of the upper members having an internally threaded hole in its extremity away from the cross member, the threaded hole of each upper member having an axis which parallels or coincides with the axis of the upper member in which the internally threaded hole is located.

2. The adapter as claimed in claim 1 wherein there are two upper members.

3. In a combination for the testing of the blowout prevention apparatus of a gas, oil, water and/or steam well comprised of a well casing, a well casing segment mounted thereon, a blowout preventer which has a pair of pipe rams, the rams being adapted to tightly seal around at least two pipes, the blowout preventer being mounted on the well casing segment, a test plug mounted in the well casing in a manner so that the test plug will not move any further into the well casing, at least two pipes, matching in number the number of pipes which the pair of rams are adapted to tightly seal around, the two pipes extending through the center passage of the blowout preventer to a position past the pair of rams, and means for injecting high pressure fluid, usually water, into the cavity formed by the central passage of the blowout preventer below the pair of rams, the central passage of the well casing segment and the central passage of the casing of the well casing above the test plub, the improvement which comprises an adapter comprised of a cross member, a lower member, which is mounted at about a right angle to the cross member, means for attaching the lower member to the test plug, at least two upper members, each of which is mounted at about a right angle to the cross member, the number of the upper members matching the number of the pipes, and means for attaching the upper members to the ends of the pipes located within the cavity.

4. The combination of claim 3 wherein there are two pipes, the pair of rams are adapted to tightly seal around the two pipes, and the adapter has two upper members.

5. The combination of claim 3 wherein the means for attaching the adapter to the test plug is a male threaded portion on the end of the lower member of the adapter engaged in an internally threaded hole on the top of the test plug.

* * * * *